United States Patent [19]

Dreulle

[11] 4,439,397

[45] Mar. 27, 1984

[54] PROCESS FOR ADJUSTING THE COMPOSITION OF A ZINC ALLOY USED IN THE GALVANIZATION OF STEEL

[76] Inventor: Noël Dreulle, 6 rue Foucques, 59500 Douai, France

[21] Appl. No.: 361,081

[22] Filed: Mar. 23, 1982

[30] Foreign Application Priority Data

Mar. 25, 1981 [FR] France ..... 81 05955

[51] Int. Cl.[3] ..... C22C 18/00

[52] U.S. Cl. ..... 420/519; 420/513; 420/514; 420/524; 427/433

[58] Field of Search ..... 420/519, 524, 514, 513; 427/433

[56] References Cited

U.S. PATENT DOCUMENTS

| | | | |
|---|---|---|---|
| 2,195,566 | 4/1940 | Gifford | 420/519 |
| 3,164,464 | 1/1965 | Heath | 420/513 |
| 3,320,040 | 5/1967 | Roc et al. | 420/519 X |
| 3,480,465 | 11/1969 | Imabayashi et al. | 420/514 X |
| 4,168,972 | 9/1979 | Dreulle | 420/519 |

FOREIGN PATENT DOCUMENTS

| | | | |
|---|---|---|---|
| 810222 | 5/1951 | Fed. Rep. of Germany | 420/519 |
| 1396546 | 3/1965 | France | 420/519 |
| 2366376 | 4/1978 | France | 420/519 |
| 51-8109 | 3/1976 | Japan | 420/519 |
| 905966 | 9/1962 | United Kingdom | 420/519 |

*Primary Examiner*—Brian E. Hearn
*Assistant Examiner*—David A. Hey
*Attorney, Agent, or Firm*—Young & Thompson

[57] ABSTRACT

Process for adjusting the composition of a zinc alloy for the galvanization of steels, the alloy having a composition including the following components expressed in ppm (by weight): lead: 1,000 to 15,000, and as additives aluminium: 100 to 5,000, tin: 300 to 20,000, and magnesium: 10 to 1,000 and being deficient in at least one of said additives, said process comprising adding to the zinc alloy one or more metal compositions which are soluble in molten zinc and which contain a relatively high proportion of the additive in which the alloy is deficient, the amount of the or each metal composition being sufficient to compensate the deficit of the additive. The tin composition is virtually pure tin; the magnesium composition is a ternary alloy of zinc, magnesium (5,000 to 50,000 ppm) and aluminium (10 to 500 ppm); and the aluminium composition is a binary zinc-/aluminium alloy containing about 5% of aluminium.

13 Claims, No Drawings

PROCESS FOR ADJUSTING THE COMPOSITION OF A ZINC ALLOY USED IN THE GALVANIZATION OF STEEL

BACKGROUND OF THE INVENTION

The present invention relates to a process for adjusting the composition of a zinc alloy suitable for the galvanisation by dipping of steels, and to metal compositions suitable for carrying out such process.

DESCRIPTION OF PRIOR ART

The zinc alloys suitable for such galvanisation of steels, including silicon steels, consist of zinc of commercial purity containing 1,000 to 15,000 ppm by weight of lead and, as additives, aluminium, tin and magnesium in the following proportions:

Al: 100 to 5,000 ppm by weight
Sn: 300 to 20,000 ppm by weight
Mg: 10 to 1,000 ppm by weight.

When this alloy composition is deficient in any one of said additives the deficiency can be made up by adding to the molten zinc alloy at least one metal composition which is soluble in molten zinc and which contains a relatively high proportion of the additive which is deficient, in an amount such that the deficit of the additive is compensated.

French Patent No. 2,366,376, filed on Oct. 1, 1976 under No. 76/29,545 and granted on Oct. 27, 1980, describes an alloy which corresponds to the above-mentioned composition and which proves to be effective in the galvanisation by dipping of silicon steels, the latter usually being known as semi-killed steels, killed steels and steels containing a high proportion of silicon.

The effect of the components of this alloy will be described briefly. Zinc of commercial purity corresponding to AFNOR Standard Specifications NFA, classes Z6 and Z7, contains defined maximum amounts of copper, cadmium and iron. In addition, it contains maximum amounts of lead (15,000 ppm for class Z6, 5,000 ppm for class Z7). These amounts of lead, defined originally by the production conditions of the zinz, have proved to be favourable for galvanisation by lowering the viscosity of the molten zinc, with the result that they are still used even though development of the metallurgical processes has made it possible to produce zinc containing proportions of lead of less than 1,000 ppm. Frequently, class Z6 or Z7 zinc is obtained by adding lead to zinc.

The presence of aluminium reduces the reactivity of the iron/zinc pair, and with the proportions indicated above, the reactivity of the zinc towards silicon steels. Tin and magnesium are active in reducing or suppressing the coating deficiencies caused by the alumina which is formed by oxidation of the aluminium. The simultaneous presence of tin and magnesium leads to noteworthy results.

However, the composition of baths for galvanisation by dipping changes during the galvanising process, since the oxidation rates of the components of the bath, namely zinc, lead and additives, at the temperature of the bath during use (of the order of 450° C.) and in the presence of the galvanising flux (zinc chloride and ammonium chloride) is different. In practice, the more oxidisable the metal, the higher is its oxidation rate. The oxidation takes place on the surface of the bath and in contact with the flux and air drawn in to the bath when the articles to be galvanised are being immersed in the bath. The main loss of materials as a result of the oxidation is essentially a loss of magnesium and aluminium.

The addition of aluminium and magnesium to the galvanisation bath presents special difficulties associated with the low density of these metals, with their high oxidisability, and, to a certain extent, with the fact that these metals are not liquid at the temperature of the molten zinc baths, namely at about 450° C. In fact, during the stage preceding the complete dispersion of the metal additives by diffusion, these light metals float on the surface of the bath, where they are exposed to oxidation by the atmosphere. The diffusion rate is a function of the diffusivity of the added metals in zinc at 450° C., and of the effective contact area between phases. Although the diffusivities of aluminium and magnesium are relatively high, the contact area decreases at the surface of the immersed parts of the blocks of added metals, and the efficiency of diffusion is greatly reduced by the presence of a layer of oxides at the interface. Under these conditions, the oxidation of the aluminium and magnesium metals is predominant over their dispersion. The same problem arises even if the metal additives are comminuted in order to increase the contact area with the molten zinc, since the surface of the metal exposed to oxidation increases to the same extent. Finally, at 450° C., magnesium, in particular when finely comminuted, is likely to ignite and cause explosions. In contrast, tin, which has a density and a melting point similar to those of zinc and which has a diffusion rate comparable to that of these metals, can be added to zinc without difficulties. Lead diffuses poorly and if added to the galvanising bath would tend to collect at the bottom of the bath. However, this metal is the least oxidisable of the elements present and virtually never needs to be added to the galvanising bath.

A well known concept in metallurgy is that if one wishes to introduce a given amount of alloying elements into a base metal, one may add to a molten base metal metal compositions containing a relatively high proportion of the required alloying elements. However, although this concept is in itself known, the nature and proportions of the constituents of the metal compositions must be determined as a function of the requisite properties, and, if several compositions must be used simultaneously, as a function of their compatibility.

It will be noted that once there is the capability to rectify the deficit of each of the additives of the galvanising alloy, this very possibility will enable this alloy to be formed from zinc of commercial purity, and the alloy will be completed by introducing the deficient additives into the molten zinc. In other words, adjusting the composition of the alloy also means producing this alloy, as well as modifying it to its former composition.

SUMMARY OF THE INVENTION

According to the present invention there is provided a process for adjusting the composition of a zinc alloy suitable for the galvanisation by dipping of steels, including silicon steels, said alloy consisting of zinc of commercial purity containing 1,000 to 15,000 ppm by weight of lead, and, as additives, aluminium, tin and magnesium in the following proportions:

Al: 100 to 5,000 ppm by weight
Sn: 300 to 20,000 ppm by weight

Mg: 10 to 1,000 ppm by weight, said alloy being deficient in at least one of said additives, in which process at least one metal composition which is soluble in molten zinc and which contains a relatively high proportion of the said deficient additive is added to the molten zinc alloy in an amount such that the deficit of the additive is compensated, and wherein the said metal compositions are: as the tin composition, the virtually pure tin metal; as the magnesium composition, a ternary zinc/magnesium/aluminium alloy containing 5,000 to 50,000 ppm by weight of magnesium and 10 to 500 ppm by weight of aluminium; and as the aluminium composition, added in an amount which takes account of the possible addition of ternary zinc/magnesium-/aluminium alloy, a binary zinc/aluminium alloy containing of the order of 5% by weight of aluminium.

DETAILED DESCRIPTION OF THE INVENTION

It has already been stated that the addition of tin to the molten zinc does not present any difficulty. To introduce aluminium virtually without modifying the proportion of the other additives, a zinc/aluminium eutectic having a melting point of 385° C. was chosen. This alloy, which is in itself known, is distinctly less oxidisable than aluminium at 450° C., by virtue of the dilution of this metal in the zinc. The choice of the metal composition for introducing the magnesium presented a few difficulties. The binary eutectic zinc/magnesium, containing 30,000 ppm of magnesium, has a solidification point of 367° C.; however, the binary zinc/magnesium alloys near the eutectic are too fragile to be shaped to ingots which can be handled. The addition of aluminium makes it possible to overcome the problem of fragility. The fragility-reducing action of aluminium, for proportions of magnesium close to that of the eutectic, starts to become substantial from 10 ppm.

Of course, the chosen composition of the zinc alloy for galvanisation will correspond to the preferred compositions mentioned in French Patent No. 2,366,376.

However, continuation of the work which led to the above-mentioned alloy compositions for galvanisation showed the advantage of adding 4 to 100 ppm by weight of beryllium to zinc of commercial purity, containing 1,000 to 15,000 ppm of lead and the aluminium, tin and magnesium additives, thus reducing the surface oxidation of the molten alloy and the flow of the molten alloy over the surface of the articles leaving the bath. Beryllium is very sparingly soluble in pure zinc (at about 450° C., the solubility is of the order of 100 ppm) and the introduction of beryllium in the form of a binary zinc/beryllium alloy is thus not practicable. The solubility of beryllium in common metals is only substantial in the case of copper, nickel, iron and aluminium. Nickel and copper are metals to be avoided in the galvanising coatings in question. It would have been possible to tolerate iron in view of the traces of iron which inevitably dissolve in the alloy during the immersion of the steel articles in the galvanising bath. However, iron/-beryllium alloys are virtually insoluble in zinc at 600° C. Beryllium is introduced by means of a ternary zinc-/aluminium/beryllium alloy produced by dissolving an aluminium/beryllium alloy, containing 4–8% of beryllium, in pure zinc. The composition by weight of the ternary alloy is 5,000 to 50,000 ppm Al with the weight ratio aluminium/beryllium being 11.5 to 24, the remainder being zinc.

It is specified that the term zinc is used here in its usually accepted meaning of a base metal containing common impurities in proportions such that the properties of the metal, in relation to the application envisaged, are not appreciably affected. The impurities are thus distinguished from the alloying or additive elements, which, in the proportions specified, do influence the properties of the base metal, in relation to the application envisaged. However, if the base metal contains, as an initial impurity, an element which is intended as an additive, in a substantially greater proportion than that of the initial impurity, the proportion as an additive is understood as being the sum of the initial proportion as an impurity and the amount of additive which is added subsequently.

A preferred composition by weight of galvanising alloy with aluminium, tin, magnesium and beryllium additives corresponds to: tin: 500±25 ppm, aluminium: 375±25 ppm, magnesium: 60±3 ppm, and beryllium: 6.5±0.5 ppm, zinc containing 1,000–15,000 ppm of lead constituting the remainder.

The preferred ternary alloys for introducing magnesium and beryllium, respectively, have the following compositions by weight: magnesium: 30,000±1,500 ppm, aluminium: 100±5 ppm, and aluminium: 9,000±450 ppm, beryllium: 470±50 ppm, the remainder being zinc in both cases.

To avoid having to monitor the contents of the galvanisation bath, too frequently, it is possible to compensate systematically for the losses of those additives which are consumed during the galvanisation. Experiments have shown that, per tonne of galvanised steel articles, it is necessary to add 2 to 25 kg of beryllium ternary alloy and 0.5 to 5 kg of magnesium ternary alloy; the amounts added are preferably 12.5±0.6 kg of beryllium ternary alloy and 1.4±0.07 kg of magnesium ternary alloy.

The developments relating to the galvanising alloy forming the subject of French Patent No. 2,366,376 have shown, as was possible to predict qualitatively, that, during the operations of galvanisation by dipping, the composition of the molten zinc alloy is modified, becoming progressively poorer in the most oxidisable additives as articles are galvanised. This oxidation, which is slow on a bath not being used, on which a layer of protective oxides forms, is greatly accelerated by the action of the galvanising fluxes (zinc chloride and ammonium chloride) and of the air drawn in during immersion of the articles to be galvanised. The reaction products of the flux and the alloy in the presence of air—generally chlorides, oxides, oxychlorides and the like—are either volatile or form the surface slags removed by scraping or skimming. It was therefore very advantageous for the users of galvanising alloy to be able periodically to readjust the composition of the molten alloy to its original composition, in order to avoid having to empty the tanks in which the alloy had reached the appropriate composition limits, and to make up the baths again with fresh alloy. These operations of renewing the baths for galvanisation by immersion proved expensive, at least in terms of immobilisation of the installation and handling, if the alloy manufacturer recovered the spent alloy in order to restore it.

Amongst the constituents of the alloy, the zinc, which constitutes at least 95% of the alloy by weight, can withstand some losses by oxidation, without the composition of the alloy being substantially modified. The lead and the tin, which are less oxidisable than the zinc, only suffer negligible losses by oxidation. On the other hand, the aluminium and the magnesium disappear relatively rapidly through oxidation. The readjustment of the composition of the alloy requires preferential additions of aluminium and magnesium.

Now, although additions of tin (density: 7.34, melting point: 231.8° C.) and of zinc of commercial purity (density: 7.14, melting point: 419° C.) do not present any difficulty when added to a bath of alloyed zinc at a temperature of about 450° C., the same does not apply to aluminium (density: 2.7, melting point: 658° C.) and magnesium (density: 1.74, melting point: 651° C.). These latter metals can only dissolve by diffusion in the molten zinc; because of their low density, they tend to float on the zinc bath. Moreover, the layer of alumina on the surface of the aluminium forms a barrier which hinders the diffusion of the aluminium. Furthermore, at the temperature of the zinc bath, the magnesium undergoes considerable oxidation and is close to its spontaneous ignition temperature in air. In the normal production of galvanising alloy, the procedure is such as to minimise the oxidation of the aluminium and the magnesium by preventing them from coming into contact with air.

It was therefore necessary to add to the aluminium and magnesium in the form of metal compositions or alloys which satisfy the following criteria:

that they only contain metals forming part of the composition of the galvanising alloy;

that they cannot be oxidised too rapidly at the melting temperature and do not require abnormal precautions in use; and that they preferably have a melting point of the order of 450° C. in order to assist diffusion by dispersing the molten additive.

Moreover, in order to permit flexible adjustment of the composition of the galvanising alloy, it is desirable for each of the metal compositions used to be allocated for a particular metal additive, in the sense that the concentration of the additive in question in the composition must be very much greater than the concentration in the alloy, whilst the concentration ratios of the other metals in the composition should not be too far from what they are in the alloy, or at least the ratios of the concentration of the constituents of the composition to the concentration of the additive in question should be distinctly lower than the ratios in the alloy.

As regards the aluminium, there is a zinc/aluminium alloy containing 5% by weight of aluminium, its composition corresponding to the eutectic with a melting point of 385° C., and this alloy is therefore suitable as the metal composition allocated for aluminium.

As regards the magnesium, there is a zinc/magnesium eutectic containing 3% by weight of magnesium, with a melting point of 367° C. This eutectic is unfortunately too fragile to be of industrial use, since the cast ingots break on cooling or during the essential transportation and handling operations. The compositions which are sufficiently similar to the eutectic to have an acceptable melting point (below about 450° C.) are also too fragile in practice. However, it has been shown that the addition of small amounts of aluminium significantly reduces the fragility of zinc/magnesium binary alloys. The effect is first evident at 10 ppm (by weight) of aluminium. Moreover, the presence of aluminium reduces the oxidation of the magnesium when the ingot is cast. At about 100 ppm of aluminium, there is virtually no further decrease in the fragility as the proportion of aluminium increases. There is no purpose in exceeding 500 ppm of aluminium; there being no advantage to compensate the loss of flexibility in the adjustment of the composition of the galvanising alloy, this loss of flexibility resulting from the fact that a deficit of magnesium is only being compensated by an enrichment in aluminium. Suitable metal compositions are obtained with 5,000 to 50,000 ppm by weight of magnesium and the above-mentioned amounts of aluminium. A composition close to the eutectic, with 30,000±1,500 ppm of magnesium and 100±5 ppm of aluminium, is preferred.

The present invention is illustrated by the following Examples.

EXAMPLE 1

Production of a zinc/magnesium/aluminium ternary alloy 485 kg of Z9-grade zinc are melted, under an inert atmosphere, in an industrial-frequency induction furnace with a 150 liter crucible, equipped for working in a controlled atmosphere. The temperature of the liquid zinc is raised to 600° C. and 15 kg of 99.9% pure magnesium is added; 50 g of 99.5% pure aluminium is then added. The temperature is then lowered to about 500° C. and kept at this value for 15 minutes so that the electromagnetic agitation can ensure the homogeneity of the alloy. The heating is then stopped and the alloy is cast into cooled ingot moulds when the temperature is from 450° to 420° C.

EXAMPLE 2

Galvanising bath containing tin, aluminium and magnesium

80 Tonnes of Z6 zinc containing 1.4% of lead, 67.3 tonnes of Z7 zinc containing 0.45% of lead, 375 kg of tin, and 1.8 tonnes of a zinc/aluminium alloy containing 5% by weight of aluminium are introduced into a galvanising tank having a capacity of 150 tonnes of zinc. After the metals have melted, 500 kg of the alloy produced according to Example 1 is added. Analysis of the bath gives, by weight: lead: 9,500 ppm, tin: 2,500 ppm, aluminium: 600 ppm, and magnesium: 99 ppm, the remainder being zinc with the usual impurities in tolerated proportions.

Additional work on the above-mentioned alloys has shown that beryllium, which is known as an element which reduces the oxidation rate of foundry alloys based on aluminium or zinc, has favourable effects on galvanising alloys, namely:

a reduction in the rate of formation of a surface layer of oxide on the molten bath;

a better flow of molten zinc over the surface of articles leaving the galvanising bath, this effect apparently resulting from a reduction in the thickness and the toughness of the layer of oxide on the zinc coating, which layer of oxide retains the excess zinc; and an improvement in the ease with which surface slags on the galvanising bath can be drawn off towards the sides of the tank prior to the immersion of the articles to be galvanised, this operation commonly being referred to as skimming.

The beneficial effect of the beryllium is observed even at very low proportions starting at 4 ppm by weight. Above 100 ppm it is found that, at the usual temperature of galvanising baths in operation, segregation of the beryllium takes place and the beryllium collects at the surface and is cleared away with the slag. It has also been found that starting from 15 ppm by weight of beryllium, for baths containing a relatively high proportion of aluminium of more than 550 ppm, there is a synergistic action of the aluminium and the beryllium on the kinetics of the iron/zinc reaction (formation of intermetallic compounds).

In the course of the preparatory work, studies on the solubility of beryllium in zinc, starting from sintered alloys of 99% pure beryllium and of pure zinc, were consulted. The liquidus curve on the binary diagram passes through the following points:

TABLE 1

| Temperature °C. | Proportion by weight of Be ppm |
|---|---|
| 696 | 800 |
| 630 | 600 |
| 611 | 530 |
| 512 | 200 |
| 486 | 150 |
| 453 | 100 |
| 429 | 64 |

This table shows that, even when using a binary alloy having a composition corresponding to the liquidus at 696° C., and cooled sufficiently rapidly for the beryllium to remain in supersaturation, the tonnages which have to be used so that the final alloy is within the range 4–100 ppm represent from 0.5 to 12.5% of the total mass of the alloy, that is to say from 0.75 to 18.75 tonnes for a bath of 150 tonnes. Furthermore, the diffusion of the beryllium in the molten zinc at temperatures remote from the melting point of the beryllium (1,280° C.) is slow, and the production of the binary alloy at temperatures above 700° C. is difficult, in particular because of the vapour pressure of the zinc (boiling point 910° C.). The production of such alloys is prohibitive on an industrial scale.

To introduce relatively high proportions of beryllium into the zinc, it was proposed to introduce this beryllium in the form of an alloy which is readily soluble in molten zinc at reasonably high temperatures, this alloy preferably being a commercially available alloy for obvious reasons of cost price. The following common alloys were found: Cu/Be containing 4% of Be, Al/Be containing 5% of Be, Fe/Be containing 10% of Be, and Ni/Be containing 25% of Be. The presence of copper or nickel in the bath for galvanisation by dipping is generally undesirable. Since iron is always present in the baths for the galvanisation of steel pieces as a result of the dissolution of iron from the pieces, the addition of a small amount of iron could be tolerated. The iron/-beryllium binary alloy proved to be virtually insoluble in zinc at 600° C.; after 48 hours at this temperature, the amounts of iron/beryllium alloy dissolved are unweighable.

On the other hand, good results were obtained by dissolving in zinc an aluminium/beryllium alloy containing 5% of beryllium at a temperature at which this alloy has melted. In practice, it is possible to use a binary alloy containing 4 to 8% of beryllium by weight, so that the weight ratio aluminium/beryllium in the ternary alloy will be from 24 to 11.5. The proportions of aluminium in the ternary alloy must be such that the melting point of the alloy is of the order of 450° C., that is to say 0.5 to 5% by weight. However, it is preferable to use a proportion of aluminium which is nearer the lower limit of the stated range in order to reduce the tendency of the beryllium to segregate.

EXAMPLE 3

Production of a zinc/aluminium/beryllium ternary alloy 495 kg of Z9 zinc are melted, under an inert atmosphere, in the induction furnace used in Example 1. The temperature is raised to about 600° C. and 4.75 kg of aluminium/beryllium alloy containing 5.25% of beryllium is added. The temperature is kept at 600° C. until the aluminium/beryllium is intimately dispersed in the zinc, under the action of electromagnetic agitation. Then, as soon as the supply has been cut off, the alloy is cast into intensely cooled ingot moulds.

The addition of beryllium also made it possible to reduce to some extent the proportions of tin in the bath, since the tin is intended in particular to take over from the magnesium when the proportion of the latter metal in the bath has fallen as a result of oxidation, and since the beryllium reduces the oxidation rate of the magnesium.

EXAMPLE 4

Galvanising bath containing tin, aluminium, magnesium and beryllium

147 Tonnes of Z7 zinc containing 0.31% by weight of lead, 75 kg of tin and 750 kg of zinc/aluminium binary alloy containing 5% of aluminium are introduced into a galvanising tank having a capacity of 150 tonnes. The mixture is heated to the melting temperature. Then, when the whole bath is molten, 300 kg of the zinc/magnesium/aluminium ternary alloy prepared according to Example 1, and 2,020 kg of the zinc/aluminium/beryllium ternary alloy prepared according to Example 3, are added.

Analysis of the bath gives, by weight: lead: 3,000 ppm, tin: 500 ppm, aluminium: 370 ppm, magnesium: 60 ppm, and beryllium: 7 ppm.

It has already been indicated that the use of metal combinations which are concentrated in respective of an additive had been developed more especially to make it possible progressively to readjust the proportions of additives in the galvanising alloys as the additives become exhausted following the galvanisation of articles, the first constitution of the baths for galvanisation by dipping benefiting from the flexibility of composition permitted by the use of these metal combinations.

The consumption of the components of the bath is partly due to the removal of alloy which forms the galvanising coating on the coated articles and partly due to the oxidation of some of these components when they come into contact either with the galvanising flux or with air drawn in by the articles during their immersion in the molten alloy.

My investigations have established that, although, strictly speaking, the consumptions of aluminium, magnesium and beryllium are essentially proportional to the amount of flux used, that is to say to the surface area of the articles to be coated, an equalisation is established between thin articles and thick articles (considering an imaginary thickness to be the ratio of the volume to the surface area of the article), so that the amounts of metal compositions introduced can be proportional to the tonnage of articles to be galvanised, without the composition of the galvanising bath changing too rapidly. This makes it possible to carry out the composition analyses, and the composition readjustments corresponding thereto, at less frequent intervals.

For a galvanising alloy produced according to Example 4, it was determined that to maintain the composition it was necessary to add metal compositions produced according to Examples 1 and 3, in amounts of from 0.5 to 5.0 kg and from 2 to 25 kg per tonne of galvanised steel, respectively.

EXAMPLE 5

Maintenance of a galvanisation bath

Articles made of structural silicon steel are galvanised, at an average rate of 20 tonnes/day, in a galvanising tank having a capacity of 150 tonnes containing 150 tonnes of a galvanising alloy produced according to Example 4.

Experiments showed that for articles of such steel, the composition of the bath was best stabilised by adding 1.4 kg of a ternary alloy according to Example 1 and 12.5 kg of a ternary alloy according to Example 3. Consequently, 28 kg of the metal composition containing magnesium according to Example 1, and 250 kg of the metal composition containing beryllium according to Example 3, are added to the bath each day, preferably during a period of inactivity.

It is possible to envisage the production of a quaternary metal composition such as that which would result from mixing the ternary alloys according to Examples 1 and 3 in the proportions corresponding to the amounts added for maintenance in Example 5.

To produce a metal composition of this type, 494 kg of Z9 zinc are melted under an inert atmosphere, and the temperature is raised to 675° C. 1.5 kg of magnesium are added, the temperature is allowed to drop to 625° C., 4.25 kg of aluminium/beryllium alloy containing 5.25% by weight of beryllium are added, and, as soon as the electromagnetic agitation has ensured the dispersion of the aluminium/beryllium, the alloy is cast into intensely cooled ingot moulds.

Of course, the invention is not limited to the examples described, but includes all the modified embodiments thereof. In particular, the compositions of alloys can vary within the ranges indicated. Moreover, where a composition is indicated by a numerical proportion for each component, it is self-evident that the numerical value is to be understood as meaning the central values within a normal range such as ±5%.

What I claim is:

1. A process for adjusting the composition of a zinc alloy suitable for the dip galvanization of steels, including silicon steels, said alloy consisting essentially of zinc of commercial purity, containing 1,000 to 15,000 ppm by weight of lead, and, as additives, aluminum, tin and magnesium in the following amounts:
Al: 100 to 5,000 ppm by weight
Sn: 300 to 20,000 ppm by weight
Mg: 10 to 1,000 ppm by weight
said alloy being deficient in at least one of aluminum and magnesium, said process comprising adding to the zinc alloy at least one metal composition which is soluble in molten zinc and which contains a substantially greater proportion of the said deficient aluminum or magnesium than that of said alloy, the amount of the metal composition added being such that the deficit is compensated, the metal composition for the magnesium deficit being a ternary zinc/magnesium/aluminum alloy containing 5,000 to 50,000 ppm by weight of magnesium and 10 to 500 ppm of aluminum; and the metal composition for an aluminum deficit being a binary zinc/aluminum alloy containing of the order to 5% by weight of aluminum, and added in an amount which takes account of the possible addition of said ternary zinc/magnesium-/aluminum alloy; and compensating any tin deficit in the zinc alloy by adding a sufficient amount of virtually pure tin.

2. Process according to claim 1, wherein the proportions of additives in the zinc alloy are:
Al: 300 to 600 ppm
Sn: 1,000 to 3,000 ppm
Mg: 20 to 200 ppm.

3. Process according to claim 1, wherein the proportions of additives are approximately:
Al: 370 ppm
Sn: 2,500 ppm
Mg: 100 ppm.

4. A process for adjusting the composition of a zinc alloy suitable for the dip galvanization of steels, including silicon steels, said alloy consisting essentially of zinc of commercial purity, containing 1,000 to 15,000 ppm by weight of lead, and, as additives, aluminum, tin and magnesium in the following proportions:
Al: 100 to 5,000 ppm by weight
Sn: 300 to 20,000 ppm by weight
Mg: 10 to 1,000 ppm by weight,
and the zinc alloy containing, as a complimentary additive, from 7 to 100 ppm by weight of beryllium, said alloy being deficient in at least one of aluminum, magnesium and beryllium, said process comprising adding to the zinc alloy at least one metal composition which is soluble in molten zinc and which contains a substantially greater proportion of the said deficient aluminum, magnesium or beryllium than that of said alloy, the amount of the metal composition added being such that the deficit is compensated, the metal composition, for a magnesium deficit being a ternary zinc/magnesium-/aluminum alloy containing 5,000 to 50,000 ppm by weight of magnesium and 10 to 500 ppm by weight of aluminum; the metal composition for a beryllium deficit being a ternary zinc/aluminum/beryllium alloy containing 5,000 to 50,000 ppm by weight of aluminum, the weight ratio aluminum/beryllium being from 11.5 to 24; and the metal composition for an aluminum deficit, added in an amount which takes account of the additions of ternary zinc/magnesium/aluminum and zinc-/aluminum/beryllium alloys, a binary zinc/aluminum alloy containing of the order of 5% by weight of aluminum.

5. A process according to claim 4, wherein the proportions of additives are:
aluminum: 375±25 ppm
magnesium: 60±3 ppm
beryllium: 6.5±0.5 ppm.

6. A ternary magnesium alloy suitable for use in a process for adjusting the composition of a zinc alloy suitable for the dip galvanization of steel, which alloy consists essentially of from 5,000 to 50,000 ppm by weight of magnesium and 10 to 500 ppm by weight of aluminum, balance essentially zinc.

7. An alloy according to claim 6, wherein the amount of magnesium is 30,000±1,500 ppm by weight and the amount of aluminum is 100±5 ppm by weight.

8. A ternary beryllium alloy suitable for use in a process for adjusting the composition of a zinc alloy suitable for the dip galvanization of steel, which alloy consists essentially of from 5,000 to 50,000 ppm by weight of aluminum, and beryllium in a weight ratio to the aluminum of 1/11.5 to 1/24, balance essentially zinc.

9. An alloy according to claim 8, wherein the amount of aluminum is 9,000±450 ppm by weight and the amount of beryllium is 470±50 ppm by weight.

10. A process according to claim 5 for maintaining the composition of the zinc alloy during the galvanization of steel, which process comprises adding to the zinc alloy per metric ton of galvanized steel from 0.5 to 5 kg of a ternary zinc/magnesium/aluminum alloy and from 2 to 25 kg of a ternary zinc/aluminum/beryllium alloy, said ternary zinc/magnesium/aluminum alloy consisting essentially of 30,000±1,500 ppm by weight of magnesium and 100±5 ppm by weight of aluminum, balance essentially zinc, and said ternary zinc/aluminum/-beryllium alloy consisting essentially of 9,000±450 ppm by weight of aluminum and 470±50 ppm by weight of beryllium, balance essentially zinc.

11. A process according to claim 10, wherein the amount of ternary beryllium alloy is 12.5±0.6 kg per metric ton of galvanized steel and the amount of ternary magnesium alloy is 1.4±0.07 kg per metric ton of galvanized steel.

12. An alloy suitable for use in a process for adjusting the composition of a zinc alloy suitable for the dip galvanization of steel, which alloy consists essentially of from 5,000 to 50,000 ppm by weight of aluminum, and beryllium in a weight ratio to the aluminum of 1/11.5 to 1/24, balance essentially zinc.

13. An alloy according to claim 12, wherein the amount of aluminum is 9,000±450 ppm by weight and the amount of beryllium is 470±50 ppm by weight.

* * * * *